US005201162A

United States Patent [19]

Focke

[11] Patent Number: 5,201,162

[45] Date of Patent: Apr. 13, 1993

[54] APPARATUS FOR PACKAGING CIGARETTES

[75] Inventor: Heinz Focke, Verden, Fed. Rep. of Germany

[73] Assignee: Focke & Co., Verden, Fed. Rep. of Germany

[21] Appl. No.: 788,441

[22] Filed: Nov. 6, 1991

[30] Foreign Application Priority Data

Nov. 7, 1990 [DE] Fed. Rep. of Germany ..... 4035397

[51] Int. Cl.[5] ..... B65B 19/04

[52] U.S. Cl. ..... 53/150; 53/149; 53/151; 131/283

[58] Field of Search ..... 198/429; 131/282, 283; 53/148, 149, 150, 151, 236

[56] References Cited

U.S. PATENT DOCUMENTS

| | | | |
|---|---|---|---|
| 2,551,199 | 5/1951 | Pasus | 53/151 |
| 4,363,332 | 12/1982 | Preston et al. | 131/283 X |
| 4,646,938 | 3/1987 | Focke | 53/151 X |
| 4,732,166 | 3/1988 | Focke et al. | 131/283 |
| 4,856,538 | 8/1989 | Focke et al. | 131/282 |

FOREIGN PATENT DOCUMENTS

| | | | |
|---|---|---|---|
| 166088 | 1/1986 | European Pat. Off. . | |
| 1757970 | 7/1971 | Fed. Rep. of Germany . | |
| 2012136 | 7/1968 | France . | |
| 2163138 | 2/1986 | United Kingdom | 53/151 |

*Primary Examiner*—John Sipos
*Assistant Examiner*—Daniel B. Moon
*Attorney, Agent, or Firm*—Sughrue, Mion, Zinn, Macpeak & Seas

[57] ABSTRACT

A cigarette magazine serves for receiving a small supply of cigarettes (10) and for forming cigarette groups which correspond to the contents of a cigarette pack. For this purpose, the cigarettes (10) are guided into upright magazine shafts (14) in which cigarette rows (15) of superposed cigarettes are formed. The cigarettes (10) are downwardly conveyed in the magazine shafts (14) under gravity. In this process there may occur problems, especially with cigarettes (10) having a filter (29). To ensure a faultless transport, the shaft walls (16) for defining the magazine shafts (14) are designed with a smaller width, such that the filters (29) of the cigarettes (10) are located beyond the region of the shaft walls (16). This ensures a trouble-free downward transport.

2 Claims, 3 Drawing Sheets

APPARATUS FOR PACKAGING CIGARETTES

BACKGROUND OF THE INVENTION

The invention relates to an apparatus for storing and conveying cigarettes (cigarette magazine) in conjunction with a cigarette packaging machine, the cigarettes being received in a funnel-shaped container having an open top and a lower portion which consists of a plurality of side by side upright shafts, each shaft serving for receiving a row of superposed cigarettes, the shafts being separated from one another by (thin) upright shaft walls.

Cigarette magazines are part of the standard equipment of a cigarette packaging machine. The cigarette magazine consists of an upper funnel-shaped accumulating container for the cigarettes and of a group of upright or slightly inclined shafts adjoining the bottom side of said accumulating container. The cigarettes are filled continuously or batchwise into the accumulating container via an upper filling orifice. Within this accumulating container, the cigarettes lie closely next to one another in a parallel orientation. The cigarettes move from the accumulating container into the shafts essentially under gravity and form rows of superposed cigarettes in the shafts. At the bottom side of the shafts, the cigarettes are discharged in groups. Several—i.e. up to three superposed—cigarettes are pushed out each time in the longitudinal direction of the cigarettes and thus form a cigarette group corresponding to the contents of a cigarette pack.

The shafts are separated from one another by thin platelike shafts walls which are spaced apart at a distance which is only slightly greater than the diameter of one cigarette. Within the shafts, the cigarettes are downwardly conveyed under gravity.

With filter cigarettes, there often occur malfunctions caused by defective movements of the cigarettes within the shafts. The conveying or falling speed of the filter cigarettes within the shafts is insufficient and as a result the speed in which the cigarette groups are pushed out is inadequate. From time to time the cigarettes jam within the shafts.

SUMMARY OF THE INVENTION

The invention is based on the object to ensure an improved feed flow of cigarettes within the shafts of the magazine by means of a novel design of the magazine.

To attain this object, the magazine according to the invention is characterized in that the shaft walls have a dimension in the longitudinal direction of the cigarettes which is reduced by the length of a filter, such that the filters of the cigarettes are located beyond the region of the shaft walls.

The invention is based on the finding that in the case of filter cigarettes, the filters are the cause for a defective cigarette flow within the shafts. On the one hand, the surface of the filter quite often has a significantly different coefficient of friction compared to the surface of the cigarette paper. Moreover, the cigarettes are often designed such that the filter has a (slightly) greater diameter than the cigarette. According to the findings of the invention, the design of the filter is thus the cause for an insufficient feed flow within the shafts.

The design of the shafts according to the invention, i.e. with "narrower" shaft walls, effectively removes the problem in a simple manner. The cigarettes are only located in the region of the shaft walls with the cigarette paper, which ensures a free downward slide of the cigarettes without any negative effects caused by the filters.

Lateral limitations of the cigarette magazine in the region of the shaft walls, i.e. side walls and a middle piece, are also formed with correspondingly reduced dimensions. A middle piece is usually found in a cigarette magazine having several side by side groups of shafts which are in each case separated from one another by a middle piece.

In the lower region, especially in the region where the cigarette groups are pushed out, the shaft walls are widened to a dimension corresponding at least to the overall length of the cigarettes.

Further features of the invention relate to details of the cigarette magazine, especially the shafts.

An exemplary embodiment of the invention will be described below in detail with reference to the drawings, in which:

DESCRIPTION OF A PREFERRED EMBODIMENT

Figure 1:
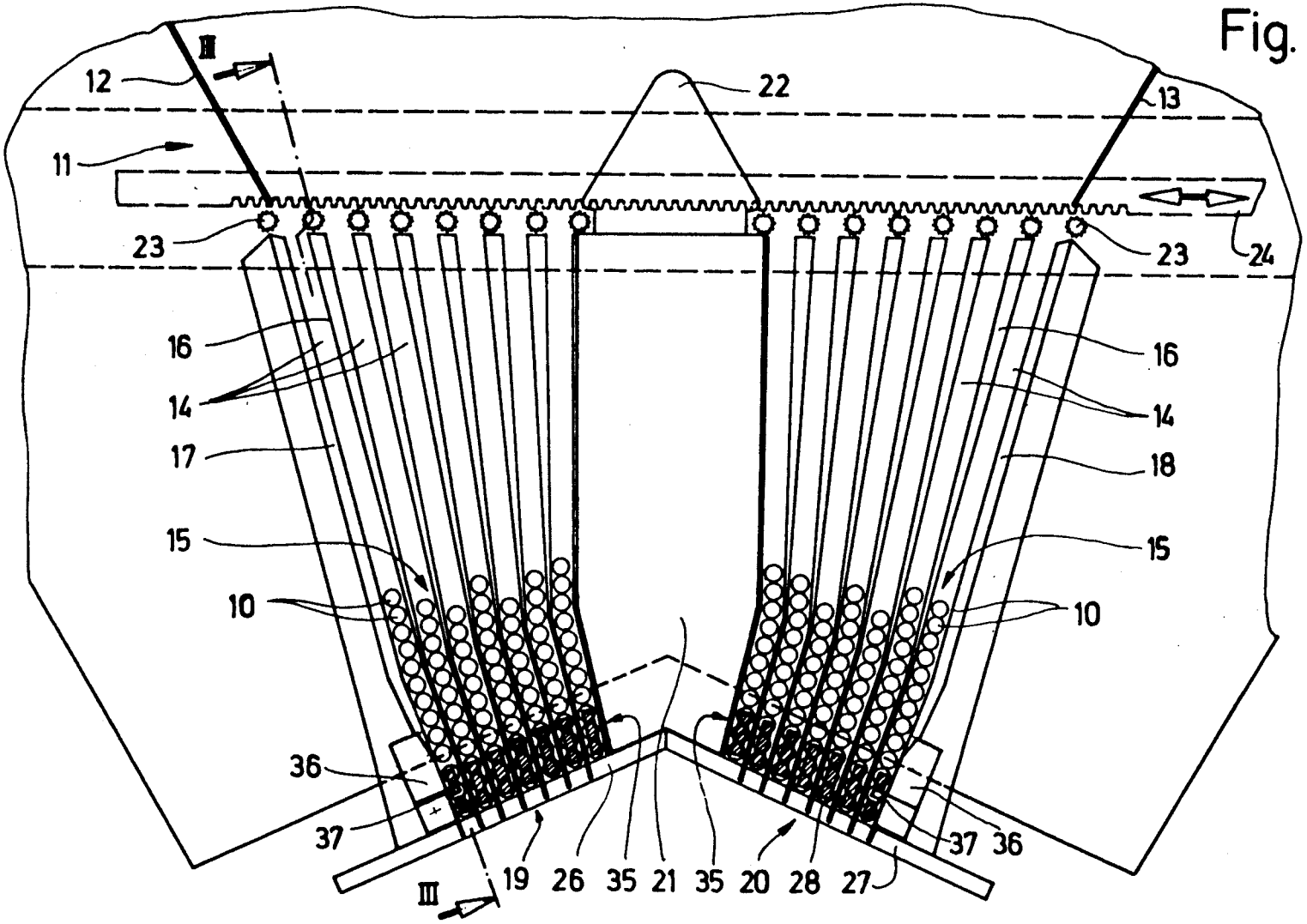
FIG. 1 is a fragmentary front view of a cigarette magazine.

A cigarette magazine forms part of a standard equipment of cigarette packaging machines. Such a magazine is for instance disclosed in U.S. Pat. No. 4,646,938. The cigarette magazine serves for receiving a supply of cigarettes 10 and for forming the cigarettes into groups, i.e. for forming cigarette groups corresponding to the contents of a cigarette pack.

The cigarette magazine illustrated consists of a top part in the form of a funnel-shaped accumulating container 11. Side walls 12, 13 of this accumulating container 11 are designed to be downwardly converging.

The accumulating container 11 merges into a plurality of magazine shafts 14 whose inside width is adapted to the diameter of the cigarettes 10. A cigarettes row 15 consisting of individual superposed cigarettes 10 is held in each magazine shaft 14. The upright or slightly inclined magazine shafts 14 are defined by shaft walls 16. The magazine shafts 14 which are located at the sides are limited by an outer wall 17 or 18.

In the present exemplary embodiment, two shaft groups 19, 20 are spaced apart from one another. Each of these shaft groups 19, 20 serves for forming an independent cigarette group corresponding to the contents of one pack. A middle piece 21 is arranged between the shaft groups 19, 20 in order to separate the confronting magazine shafts 14 located on the inside. At the top, the middle piece 21 is provided with an extension in the form of a guide piece 22 located within the accumulating container 11 and having an approximately triangular cross-section. The purpose of this guide piece 22 is to guide the cigarettes 10 from the accumulating container into the one or the other shaft group 19, 20.

To facilitate the entry of the cigarettes 10 into the magazine shafts 14, jolting rods 23 are rotatably mounted at the upper entry side in the region of the shaft walls 16. These jolting rods 23 are driven to rotate backwards and forwards via a mechanism with toothed rack 24 and pinion 25 which is arranged outside the accumulating container 11.

The cigarettes 10 are conveyed within the cigarette magazine and most of all within the magazine shafts 14 under gravity, particularly until they come to rest on an evacuation plate 26, 27. The evacuation plates 26, 27, which are designed for the cigarette rows 15 to rest on, are arranged at the lower ends of the two shaft groups 19, 20 at an obtuse angle relative to one another. The shaft walls 16 are anchored in this evacuation plate 26, 27 with their lower ends.

Figure 2:
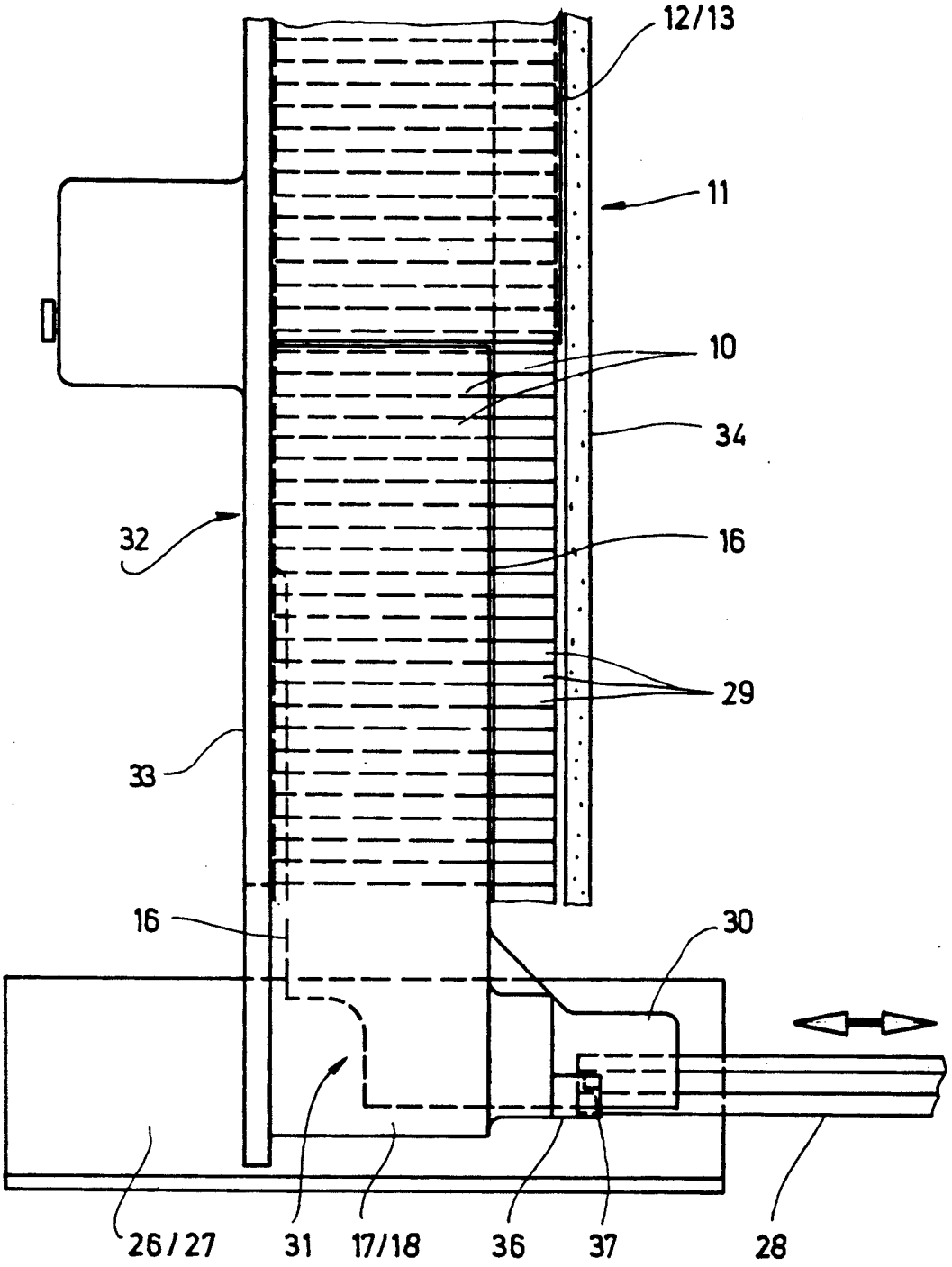
FIG. 2 is a side view of the cigarette magazine according to FIG. 1.
Figure 3:
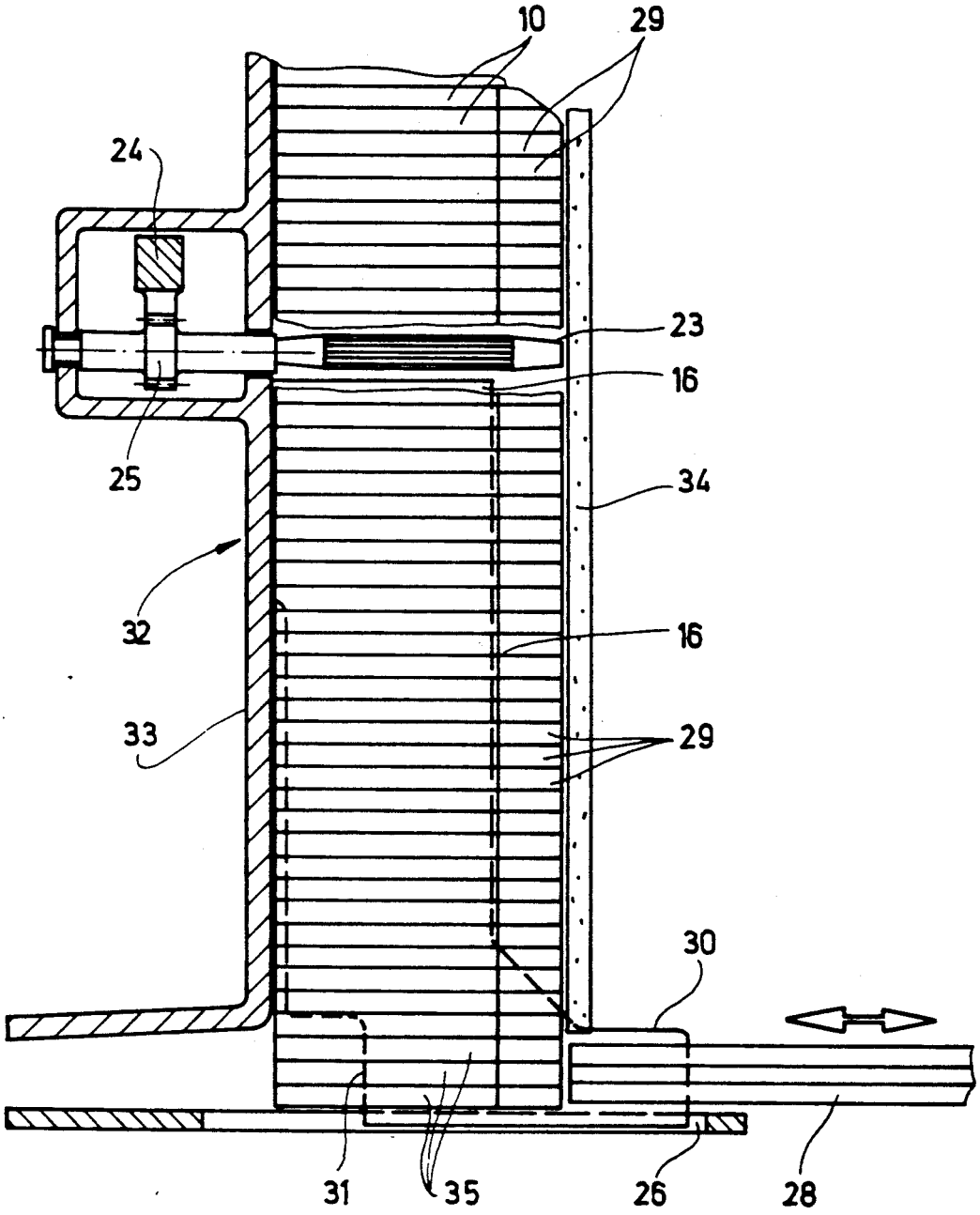
FIG. 3 is a cross-section of the cigarette magazine taken along the line III—III of FIG. 1.

A reciprocating slide 28 serves for pushing off the cigarettes, i.e. a cigarette group. Such a slide 28 is assigned to each magazine shaft 14. The slides 28 of one shaft group 19, 20 are connected at their free ends to form a unit. The slides 28 enter the magazine shafts 14 together and their dimensions are defined such that with one push-off cycle three superposed cigarettes 10 of each magazine shaft 14 are engaged and pushed out. After the slides 28 have returned to their initial position as illustrated in FIG. 2 or FIG. 3, the cigarettes can fall or slide under gravity in the magazine shafts 14 until they come to rest on the evacuation plates 26, 27.

The above described downward movement of the cigarettes 10 in the magazine shafts 14 can lead to malfunctions particularly in the case of cigarettes comprising a filter 29. To avoid such malfunctions in the region of the magazine shafts, the shaft walls 16 are designed with a width—the dimension in the longitudinal direction of the cigarettes—which is smaller than the length of a cigarette 10. As is evident particularly from FIGS. 2 and 3, the assembly is defined such that the filter 29 of the cigarettes 10, which are unidirected with respect to their filters, are not enclosed, which means they are located beyond the region of the shaft walls 16. Only the filter-free portion of the cigarettes 10 is laterally guided by the shaft walls 16.

In the present exemplary embodiment, the shaft walls are designed with a reduced width over the main portion of their overall height, particularly from the top free edge to a lower portion of the shaft walls 16. The lower portion of the shaft walls 16 is designed with a greater width, mainly in the region where the cigarette groups are pushed out, i.e. in the effective range of the slides 28. Here, the shaft walls 16 extend over the entire length of the cigarettes 10, i.e. including the filters 29. In addition, a guide extension 30 of the shaft walls 16 is located in the lower portion and laterally projects from the cigarette magazine. The region opposite the shaft walls is provided with a recess 31 so that the cigarettes can be more easily pushed out of the region of the shaft walls.

Only a top portion 32 of the shaft walls 16 is connected with a rear wall 33 of the cigarette magazine. The lower portion of the shaft walls 16 extends at a small distance from the rear wall 33.

In accordance with the solution of the problem, the outer walls 17, 18 of the shaft groups 19, 20 of the present exemplary embodiment are also designed with a reduced width in the longitudinal direction of the cigarettes, just like the shaft walls 16. Moreover, the middle piece 21 also has reduced dimensions in the longitudinal direction of the cigarettes 10. The guide piece 22 located in the region of the accumulating container 11, on the other hand, is designed with the full length or width, corresponding to the dimensions of the cigarette magazine.

A front cover plate 34, which is usually made of a transparent material such as acrylic material, extends in the closed position at a small distance from the free ends of the cigarettes 10 or filters 29. The cover plate 34 is pivotably mounted via a hinge in a top region, particularly in the region of the accumulating container 11.

A special feature is provided in the lower region of the magazine shaft 14. To push out three-layered cigarette groups with a reduced number of cigarettes in a middle layer 35, a retaining piece 36 is arranged at each outer wall 17, 18 of the shaft groups 19, 20. This retaining piece 36 has a finger-like extension 37 which projects into the magazine shaft 14 located at the side in the region of the middle layer 35. This extension 37 retains the middle cigarette 10 in the magazine shaft 14 located at the side when a cigarette group is pushed out, so that the middle layer consists of a reduced number of 6 cigarettes.

I claim:

1. In an apparatus for storing and conveying filter cigarettes in conjunction with a cigarette packaging machine, the improvement:

wherein the filter cigarettes (10) are received in a funnel-shaped accumulating container (11) having an open top and a lower portion which is formed from a plurality of side-by-side upright magazine shafts (14);

wherein each magazine shaft is adapted to receive a row of superposed filter cigarettes (10);

wherein the magazine shafts (14) are separated from one another by upright shaft walls (16);

wherein the shaft walls (16) have a smaller dimension than the cigarettes (10) in a longitudinal direction of a length of the cigarettes (10), such that a clearance is formed between the shaft walls (16) and a cover plate (34), said clearance being slightly greater than the length of a filter (29) of the filter cigarettes (10);

means for directing the cigarettes into the magazine shafts (14), so that the entire filters (29) of the filter cigarettes (10) are located in the clearance and beyond the shaft walls (16);

wherein the magazine shafts comprise downwardly converging outer walls (17, 18) having a width which is smaller than the length of the cigarettes (10), a clearance between the outer wall (17, 18) and the cover plate (34) being formed on a same side as the clearance between the shaft walls (16) and the cover plate (34); and wherein a middle piece (21) is located between two groups (19, 20) of magazine shafts (14) and has a width which is smaller than the length of the cigarettes (10) in accordance with dimensions of the shaft walls (16) and the outer walls (17, 18).

2. The apparatus as claimed in claim 1, wherein the shaft walls (16) have a width, in a lower region where the cigarettes (10) are pushed out of the magazine shafts (14), which corresponds at least to the length of the cigarettes (10).

* * * * *